United States Patent [19]

Shih-Chin

[11] Patent Number: 4,703,152

[45] Date of Patent: Oct. 27, 1987

[54] TILTABLE AND ADJUSTABLY OSCILLATABLE PORTABLE ELECTRIC HEATER/FAN

[75] Inventor: Shao Shih-Chin, San-Chung, Taiwan

[73] Assignee: Holmes Products Corp., Holliston, Mass.

[21] Appl. No.: 807,822

[22] Filed: Dec. 11, 1985

[51] Int. Cl.[4] ..... H05B 1/02; F04D 25/10; F24H 3/04; H02P 1/46

[52] U.S. Cl. ..... 219/370; 219/348; 219/364; 219/366; 318/282; 318/286; 416/100; 416/110

[58] Field of Search ..... 219/359, 364, 366–372, 219/348; 318/282, 286; 416/100, 110

[56] References Cited

U.S. PATENT DOCUMENTS

| | | | |
|---|---|---|---|
| 2,082,506 | 6/1937 | Murphy | 318/282 X |
| 2,105,514 | 1/1938 | Welch | 218/282 X |
| 2,449,377 | 9/1948 | Green | 416/100 |
| 2,618,434 | 11/1952 | Farnsworth | 416/100 |
| 2,765,977 | 10/1956 | Morrison | 416/100 X |
| 3,377,465 | 4/1968 | Ronk | 219/370 X |

FOREIGN PATENT DOCUMENTS

| | | | |
|---|---|---|---|
| 185893 | 10/1984 | Japan | 416/100 |

*Primary Examiner*—Anthony Bartis
*Attorney, Agent, or Firm*—Irving M. Kriegsman

[57] ABSTRACT

A portable electric heater/fan which can oscillate from side to side over a distance of 45 degrees or 90 degrees or remain stationary and which can also be tilted backward or forward so as to provide a beam of hot or cold air whose lateral extent and direction can be adjusted over two mutually perpendicular axes includes a compartment containing a heater/fan assembly and being slidably mounted for back and forth tilting movement on a neck joint fixed to a main gear carried by a shaft mounted for rotation about a vertical axis on a base. The main gear is coupled by a drive gear to the shaft of a synchronous electric motor mounted on the base. A first and a second set of cooperable limit stops are provided on the base and main gear for limiting the rotation of the main gear by the motor to either 90 degrees for the first set or 45 degrees for the second set. A unitary piano-type switch assembly is provided on the base for selectively electrically energizing the synchronous motor and simultaneously selectively mechanically rendering either the first or second set of stops operative to select the angular distance of oscillation of the compartment containing the heater/fan.

7 Claims, 9 Drawing Figures

TILTABLE AND ADJUSTABLY OSCILLATABLE PORTABLE ELECTRIC HEATER/FAN

BACKGROUND OF THE INVENTION

The present invention relates generally to heater/fans and more particularly to a heater/fan which can be set to oscillate from side to side over either one of two angular distances or remain stationary and which also can be tilted either backward or forward.

Heater/fans are known in the art. These devices are usually portable and are intended to be placed on a table, desk, counter or other similar surface and when desired or necessary can be easily moved from one place to another. These devices generally comprise a compartment which is either fixedly mounted or integrally formed on a supporting base. A combination heater and fan are fixedly mounted inside the compartment. In use, the device can be operated so that only the fan is turned and cool air is emitted or so that the fan and heater are both turned on and hot air is emitted. The fan speed is often adjustable as is common with fans and the heater is often thermostatically controlled as is common with heaters. Because of the mounting arrangement of the compartment on the supporting base the angular zone covered by the beam of emitted air, whether it is hot air or cold air, is fixed. It would be desirable to be able to control or change the size and area covered by the emitted air.

For example, at one particular time it may be desirable to generate a beam of air (hot or cold) to cover a zone occupied by one person while at another time it may be desirable to generate a beam of air to cover a zone occupied by several persons, which is appropriately larger in size. Also, depending on where the heater/fan is placed relative to the persons intended to receive the benefits therefrom or the particular location in which the user wishes to have the air directed, it is often desirable or necessary to be able to tilt the device in an upward or a downward direction.

Accordingly, it is an object of this invention to provide a new and improved heater/fan.

It is an additional object of this invention to provide a heater/fan that is portable.

It is another object of this invention to provide a heater/fan which oscillates from side to side.

It is still another object of this invention to provide a heater/fan which oscillates from side to side over either one of two pre-selected angular distances, such as 45 and 90 degrees.

It is yet still another object of this invention to provide a heater/fan which can be tilted backward or forward.

It is a further object of this invention to provide a heater/fan having a new and novel arrangement for producing oscillation from side to side.

It is another object of this invention to provide a heater/fan which can be tilted backward and/or forward and then remain in the position so moved without having to loosen or tighten any screws, nuts or similar hardware.

SUMMARY OF THE INVENTION

A heater/fan which is portable and which can be made to oscillate from side to side over either one or two angular distances or remain stationary and which can also be tilted backward or forward so as to provide a beam of hot or cold air that can be made to vary in size and direction over two mutually perpendicular axes constructed according to this invention comprises a base, a shaft mounted on the base for rotation about a vertical axis and a main gear fixedly mounted on the shaft. A synchronous motor is mounted on the base and is operatively connected by an auxiliary gear to the main gear for causing the main gear to rotate. Switch means are provided for energizing the synchronous motor and limit means operative also by the switch means are provided for causing the synchronous motor to reverse its direction of rotation after the main gear turns either a first angular distance or a second angular distance. A neck joint is fixedly mounted on the main gear. A heater/fan assembly compartment is slidably mounted on the neck joint for tilting movement relative to the neck joint in either a forward or a rearward direction and a heater/fan assembly is mounted in the compartment.

The foreoing and other objects and advantages will appear from the description to follow. In the description, reference is made to the accompanying drawings which forms a part thereof, and which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

In the following detailed description the two angles of side-to-side oscillation are 45 degrees and 90 degrees. However, these two angles are for illustrative purposes only, as will hereinafter become readily apparent.

BRIEF DESCRIPTION OF THE DRAWINGS

In the drawings wherein like reference numerals represent like parts.

DETAILED DESCRIPTION OF PREFERRED EMBODIMENTS

The present invention relates to a portable heater/fan which can be set to either oscillate from side to side about either one of two predetermined angular distances or remain stationary and which can also be tilted in a backward direction or in a forward direction so as to provide a beam of air (which is either hot or cold and) whose size and direction can be adjusted over two mutually perpendicular axes.

Figure 1:
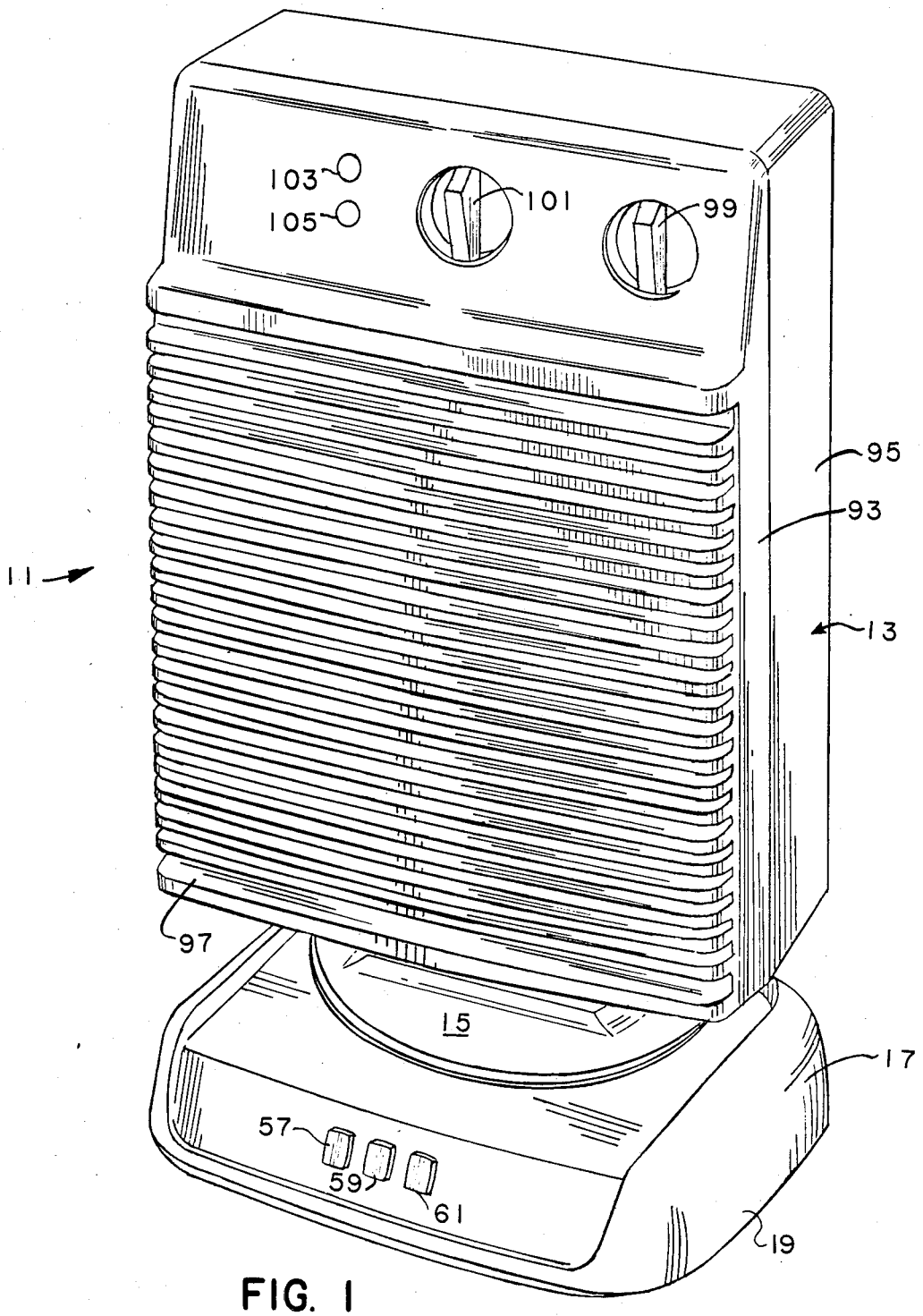
FIG. 1 is a perspective view taken from the front of a heater/fan constructed according to the teachings of the present invention.
Figure 2:
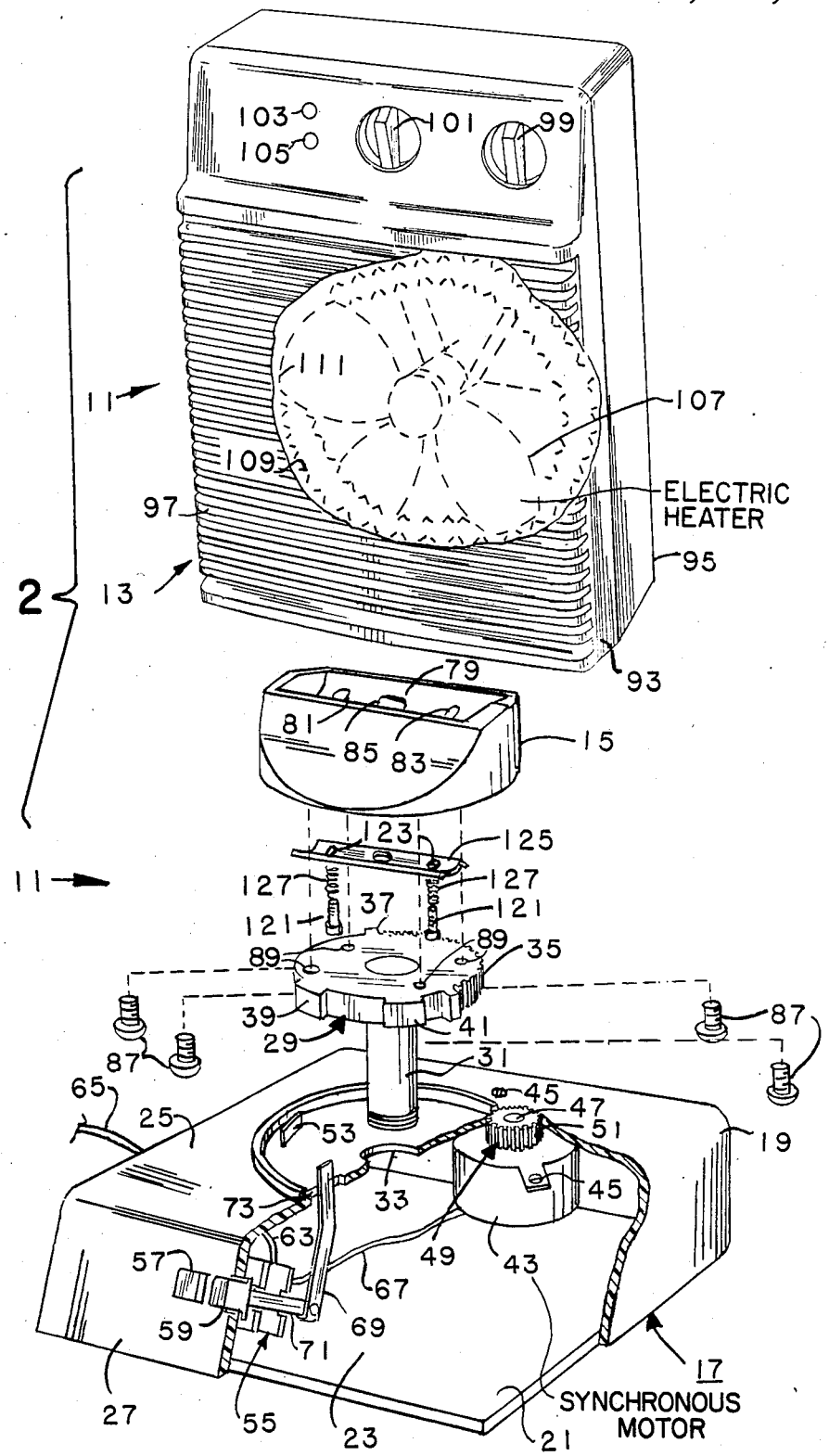
FIG. 2 is an exploded simplified perspective view of the heater/fan shown in FIG. 1 with certain parts being omitted for simplicity.

Referring now to the drawings, and first to FIGS. 1 and 2 there is shown a heater/fan constructed according to the teachings of the present invention and identified generally by reference numeral 11.

Heater/fan 11 includes a compartment 13, a neck joint 15 and a base 17.

For simplicity, parts of heater/fan 11 not pertinent to the invention will not be shown or discussed.

Compartment 13 is mounted on neck joint 15 for tilting movement in either a forward direction or in a backward direction and neck joint 15 is mounted on base 17 for rotational movement about a vertical axis.

In use, heater/fan 11 is placed on a table, a desk top, a floor or other similar surfaces.

Base 17 s generally rectangular in shape and is made of plastic or other suitable material. Base 17 includes a generally rectangular cavity shaped top cover 19 and a generally rectangular bottom plate 21. Cover 19 and plate 21 are secured together by screws (not shown) or other suitable means so as to define a chamber 23. Top cover 19 includes a top surface 25 and a front surface 27.

A main gear 29 is fixedly secured to a main shaft 31 which is rotably mounted in circular hole 33 formed in top 25 of top cover 19. Main gear 29 includes teeth 35 over a portion of its periphery and three stops or projections 37, 39 and 41 over the other portion of its periphery. The arcuate distance from stop 37 to stop 39 is about 90 degrees and the arcuate distance from stop 39 to stop 41 is about 45 degrees.

A synchronous motor 43 is located inside chamber 23 and fixedly connected to top surface 25 of top cover 19 by screws 45. As is well known, a synchronous motor is a type of motor that has a rotor that will continuously rotate in one direction until it is stopped and once the rotor is stopped it will start to rotate again in the opposite direction.

Synchronous motor 43 includes a drive shaft 47 which extends out of top surface 25 of top cover 19 through a suitably positioned hole (not shown) of appropriate size so as not to interfere with the shaft rotation. A second gear 49 is fixedly secured by any suitable means (not shown) to drive shaft 47. Gear 49 has teeth 51 which are in operative engagement with main gear 29. Thus gear 49 is a driving gear and gear 29 is a driven gear. Gears 29 and 49 are sized relative to each other so that one complete rotation of gear 49 will produce only a partial rotation of gear 29. Thus, gear 29 will turn at a slower speed than gear 49.

A fixed stop bar 53 is integrally formed on the top surface 25 of top cover 19 and cooperates as with stops 37 and 39 in a manner which will hereinafter be described in more detail to cause main gear 29 to oscillate from side to side over an angle of about 90 degrees.

A multipurpose piano type switch 55 having three buttons 57, 59 and 61 is fixedly mounted by screws (not shown) on front 27 of front cover 19. Switch 55 serves two basic purposes, namely (1) to energize or de-energize synchronous motor 43 and (2) to allow the size of the angle of oscillation of main gear 29 to be controlled as will hereinafter also be described. Switch 55 is connected by wires 63 to a power cord 65 which is adapted to be connected to an electrical power outlet and is also connected by wires 67 to synchronous motor 43. Switch 55 includes a movable and pivotal lever arm 69 which is mechanically connected by a linkage 71 to button 59 and extends out of top surface 25 of top cover 19 through an elongated radial slot 73. Lever arm or bar 69 can be moved inward or outward within radial slot 73. Lever arm 69 cooperates with stops 39 and 41 on main gear 29, as will hereinafter be explained, to limit the oscillating movement of main gear 29 from a 90 degree arc to a 45 degree arc, when this smaller angle of oscillation is desired.

Figure 3:
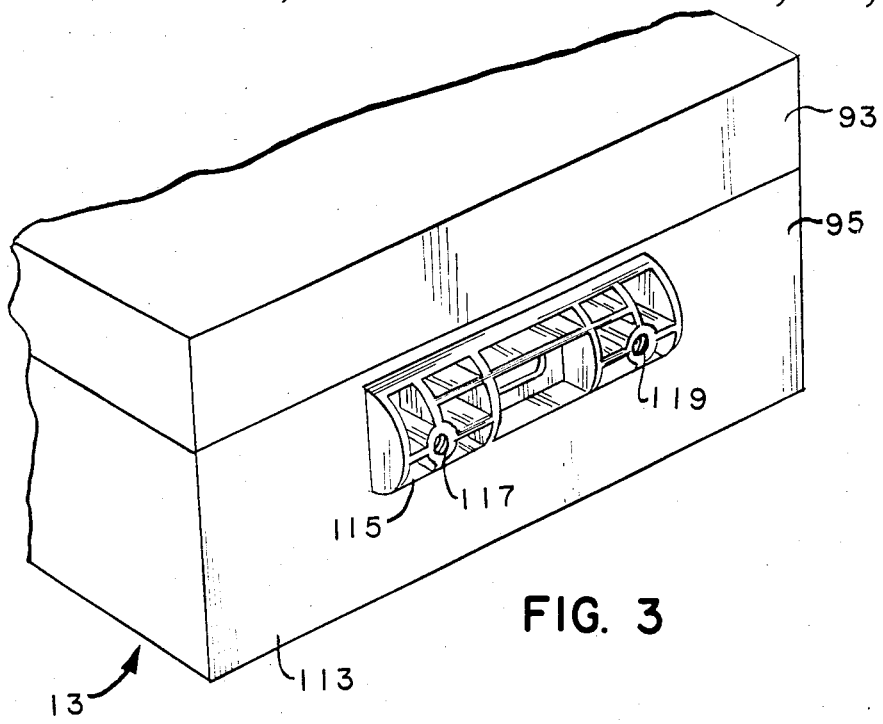
FIG. 3 is a perspective view taken from the bottom of the bottom end of the compartment shown in FIG. 1.
Figure 4:
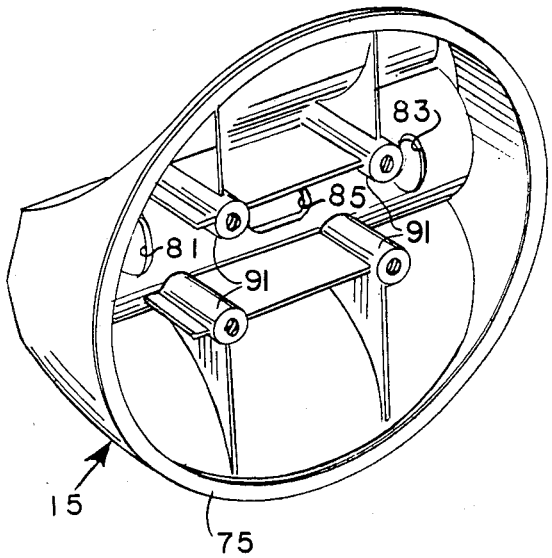
FIG. 4 is a perspective view taken from the bottom of the neck joint shown in FIG. 2.
Figure 5:
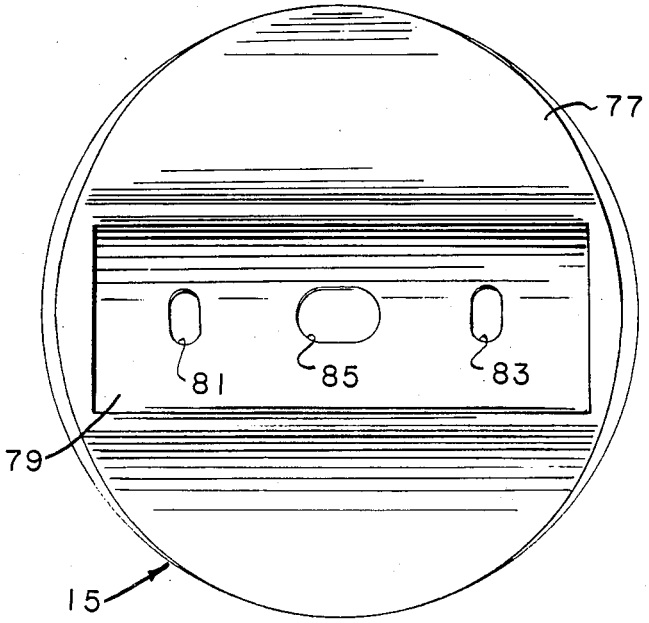
FIG. 5 is a perspective view taken from the top of the neck joint shown in FIG. 2.

Neck joint 15 (see also FIGS. 4 and 5) is a unitary structure made of plastic and has a bottom 75 that is circular in shape and a top 77 that includes an elongated, longitudinal semi-cylindrical recess 79. A pair of slots 81 and 83 and an oval shaped hole 85 are formed in the recessed portion 79 (see FIG. 3). Neck joint 15 is fixedly mounted on main gear 29 by a set of four screws 87 which extend up through mounting holes 89 formed in main gear 29 and into integrally formed internally threaded bosses 91 formed at the bottom of neck joint 15 (See FIG. 4).

Compartment 13 includes a general rectangular shell shaped front enclosure 93 and a generally rectangular shell shaped rear enclousre 95 which are fastened together by screws (not shown). Both enclosure parts are made of plastic or other suitable material. Front enclosure 93 includes an integrally formed grill portion 97. Control knobs 99 and 101 for regulating the temperature and the fan speed and power and temperature indicator lights 103 and 105 are mounted near the top of front enclosure.

A heater/fan assembly 107 is fixedly mounted inside compartment 13 by any suitable means. Assembly 107 includes a heater coil 109 and a fan 111. Since the particular construction of the heater/fan assembly 107 is not considered a part of this invention, the construction will not be described or shown in more detail. Heater/fan assembly 107 receives its electrical power through wires (not shown) which are connected to core 65 and which extend up into compartment 13 from base 17 through shaft 31 and through hole 85.

The bottom wall 113 of rear enclosure 95 includes an integrally formed, ribbed, semi-cylindrically shaped roller 115 having a pair of integrally formed internally threaded bosses 117 and 119. Roller 115 is slidably mounted in recess 79 of neck joint 15 for tilting movement in a backward and forward direction and is secured to neck joint 15 by a pair of screws 121 which extend up through circular holes 123 in an elongated rectangularly shaped concave attaching plate 125, through slots 81 and 83 in recess 79 of neck joint 15 and into engagement with the internally threaded bosses 117 and 119 in roller 15. Holes 123 are positioned in alignment with to slots 81 and 83. Screws 121 are loaded with springs 127 which push up against plate 125. Screws 121 are tightened sufficiently in bosses 117 and 119 so that roller 115 will not slip or rock within recess 79 regardless of its angular position. However, because of the springs 127, roller 115 and hence compartment 13 is movable back and forth, with the amount of tilting movement being according to the length of slots 81 and 83.

Figure 8:
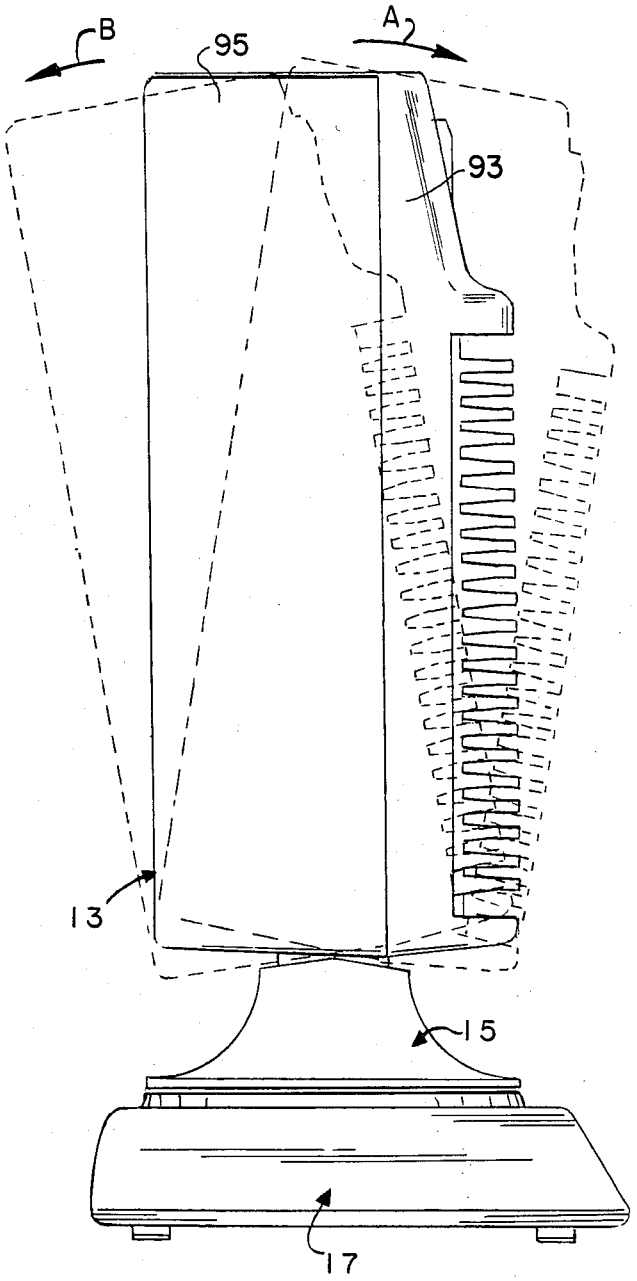
FIG. 8 is a side elevation view of the heater/fan shown in FIG. 1 ilustrating how the main compartment can be positioned in a either a normal or straight up position (solid lines), a tilted forward position (dotted lines) or a tilted backward position (dotted lines)

As can be seen, compartment 13 can be tilted in a forward direction (See Arrow A in FIG. 8) or in a rearward direction (See Arrow B in FIG. 8) relative to neck joint 15 by simply pushing on compartment 13 with sufficient force to overcome the spring loaded mounting arrangement of compartment 13 on neck joint 15 and once tilted will stay in that position without slipping until it is pushed again. It is not necessary to tighten or loosen any screws or nuts etc. either prior to tilting the compartment or after tilting the compartment. In FIG. 8, compartment 13 is shown in a straight vertical position (solid lines) in a tilted forward position (dotted lines) and in a tilted backward position (dotted lines).

The arrangement for producing oscillating movement of compartment 13 relative to base 17 of two different angular positions or maintaining compartment 13 stationary relative to base 17 will now be discussed.

The three buttoms 57, 59 and 61 in switch 55 are mechanically connected such that when one of the three buttons is pushed in the other two buttons will be placed in a non-depressed position (i.e. not pushed in).

When button 57 is depressed, motor 43 is not energized and compartment 13 will not rotate. It will remain fixed in whatever position it is in at the time the button is depressed.

Figure 6:
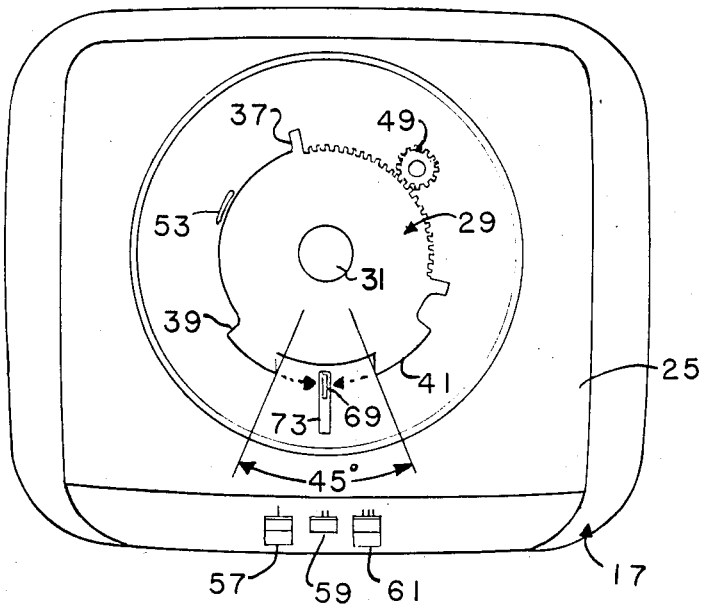
FIG. 6 is a top view of the base and main gear shown in FIG. 2 with the switches arranged for 45 degree side to side oscillation.

When button 59 is depressed, motor 43 will be energized causing main gear 29 to turn (rotate). At the same time, when button 59 is depressed, lever arm 69 is pushed radially inward to the position shown in FIG. 6. When lever bar 69 is in its "radially in" position it will hit up against stop 39 when gear 29 turns in a clockwise direction and hit up against stop 41 when gear 29 moves in a counterclockwise direction. When stop 39 hits up against bar 69 it will cause the rotor in synchronous motor 43 to stop and then reverse its direction or rotation and when stop 41 hits up against bar 69 it will also cause the rotor to stop and then reverse its direction or rotation. Thus, when button 59 is depressed, gear 29 and hence compartment 13 will oscillate from side to side (between stops 39 and 41) over an angular distance of about 45 degrees (i.e. the arcuate or circumferential distance between the two stops 39 and 41).

Figure 7:
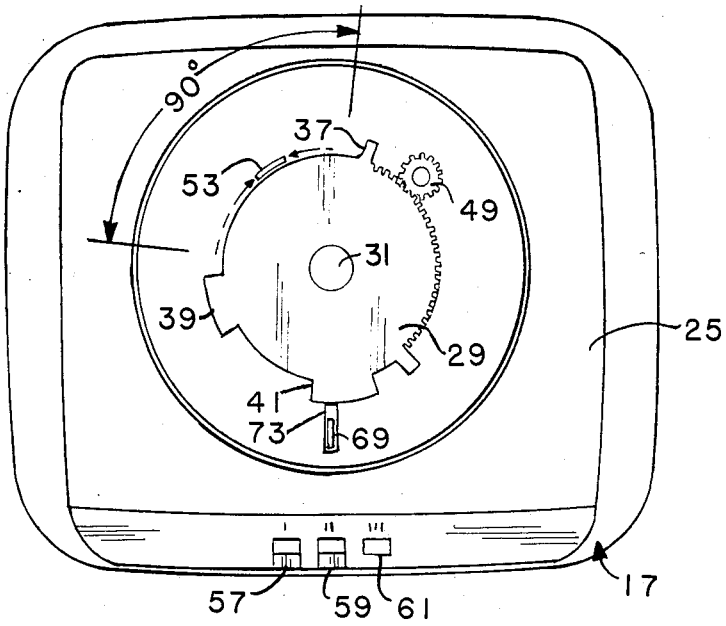
FIG. 7 is a top view of the base and main gear shown in FIG. 2 with the switches arranged for 90 degree side to side oscillation.

When button 61 is depressed, motor 43 is also energized. At the same time, lever arm 69 is withdrawn back to its "outer" position as shown in FIG. 7. When lever arm 69 is in its "outer" position as shown in FIG. 7 it will not hit up against stops 39 and 41 as gear 29 rotates and thus will not limit the angle of rotation of main gear 29 to 45 degrees. Instead, the angular distance over which gear 25 will rotate is determined by fixed bar 53 and stops 37 and 39 which are spaced 90 degrees apart. When stop 37 hits up against bar 53 it will cause the rotor in motor 31 to stop and then reverse its direction of rotation and when stop 39 hits up against bar 39 the rotor in motor 31 will once again be stopped and then reverse direction. Thus, when button 61 is depressed, main gear 29 will oscillate from side to side over an angular distance of about 90 degrees.

As can be appreciated, compartment 13 can be made to oscillate from side to side over either about 45 degrees by pushing in button 59 or about 90 degrees by pushing in button 61.

Figure 9:
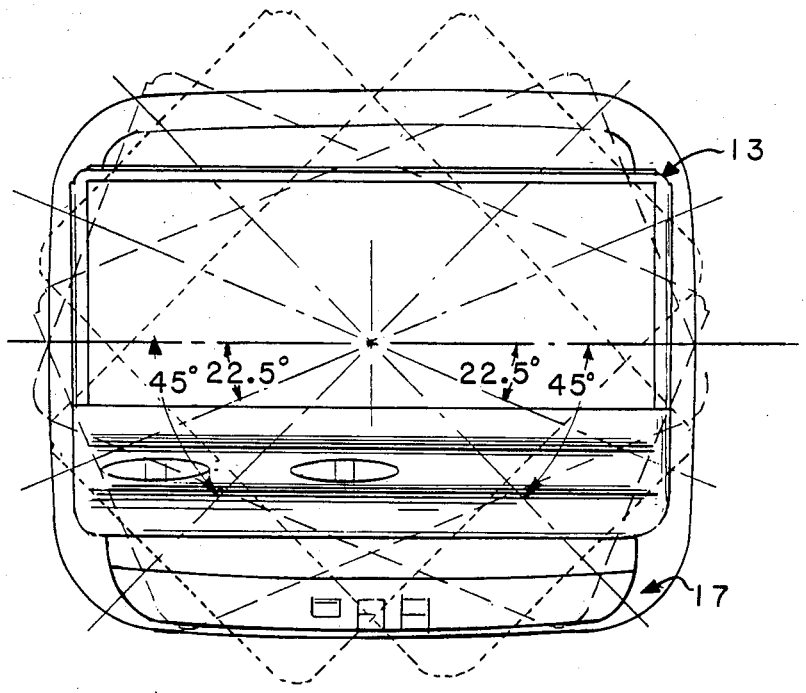
FIG. 9 is a top view of the heater/fan illustrated in FIG. 1 showing how the main compartment can be positioned in a normal position (solid lines), can be rotated to the left and right over one angular distance (dotted lines) and can be rotated to the left and right over another angular distance (dotted lines).

The limits over which compartment 13 will turn when button 61 is depressed (i.e. a 90 degree sweep, 45 degrees to each side) and whn button 59 is depressed (i.e. a 45 degree sweep, 22½ degree on each side) are shown in FIG. 9.

Switch 55 may be a model number 41K103082 piano switch made by Dee Ven Enterprise Ltd. of Taiwan.

As can be appreciated, the two particular angular distances of oscillation (i.e. 45 degrees and 90 degrees) are for illustrative purposes only.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A portable heater/fan which can be made to oscillate from side to side over either one of two different angular distances or remain stationary and which can be tilted backward or forward so as to provide a beam of hot or cold air whose lateral extent and direction can be adjusted over two mutually perpendicular axes, said heater/fan comprising:

a. a base adapted to be placed on a horizontal surface for supporting the heater/fan, b. a shaft mounted on said base for rotation about a vertical axis.

c. a main gear fixedly mounted on said shaft for rotation therewith, d. a synchronous electric motor mounted on said base and operatively connected to said main gear for causing said main gear to rotate with said shaft about said vertical axis, e. first cooperable limit means on said base and said main gear for causing said synchronous motor to oscillate said main gear through a first angular distance about said vertical axis.

f. second cooperable limit means on said base and said main gear for causing said synchronous motor to oscillate said main gear through a second angular distance about said vertical axis smaller than said first angular distance, g. switch means for selectively actuating said synchronous motor and for selectively rendering either said first limit means or said second limit means operative to select the angular distance of oscillation of said main gear about said vertical axis.

h. a neck joint fixedly mounted on said main gear for oscillating therewith, i. a compartment having a heater/fan assembly for providing a beam of hot or cold air through the forward end thereof, and j. means for pivotally mounting said compartment on said neck joint for selective tilting movement in either a forward or rearward direction relative to said base, said switch means being a unitary switch assembly including an electrical means for energizing the synchronous motor and mechanical means for simultaneously selectively rendering either the first or second limit means operative.

2. A portable heater/fan which can be made to oscillate from side to side over either one of two different angular distances or remain stationary and which can be tilted backward or forward so as to provide a beam of hot or cold air whose lateral extent and direction can be adjusted over two mutually perpendicular axes, said heater/fan comprising:

a. a base adapted to be placed on a horizontal surface for supporting the heater/fan.

b. a shaft mounted on said base for rotation about a vertical axis, c. a main gear fixedly mounted on said shaft for rotation therewith, d. a synchronous electric motor mounted on said base and operatively connected to said main gear for causing said main gear to rotate with said shaft about said vertical axis, e. first cooperable limit means on said base and said main gear for causing said synchronous motor to oscillate said main gear through a first angular distance about said vertical axis.

f. second cooperable limit means on said base and said main gear for causing said synchronous motor to oscillate said main gear through a second angular distance about said vertical axis smaller than said first angular distance.

g. switch means for selectively actuating said synchronous motor and for selectively rendering either said first limit means or said second limit means operative to select the angular distance of oscillation of said main gear about said vertical axis.

h. a neck joint fixedly mounted on said main gear for oscillating therewith.

i. a compartment having a heater/fan for selectively providing a beam of hot or cold air through the forward end thereof, and j. means for pivotally mounting said compartment on said neck joint for selective tilting movement in either a forward or rearward direction relative to said base.

k. said first cooperable limit means comprising:

i. a first stop on the periphery of said main gear, ii. a second stop on the periphery of said main gear at a first arcuate distance from said first stop, and iii. a first fixed bar on said base positioned between said first stop and said second stop so as to hit said first stop when said main gear rotates a predetermined distance in one direction and so as to hit said second stop when said main gear rotates a predetermined distance in the other direction, l. said second cooperable limit means comprising:

i. said second stop on the periphery of said main gear ii. a third stop on the periphery of said main gear on the side opposite said first stop and at a second arcuate distance from said second stop, said second arcuate distance being less than said first arcuate distance, and iii. a second bar on said base selectively movable by said switch means into position between said second stop and said third stop so as to hit said second stop when said main gear rotates a predetermined distance in one direction and to hit said third stop when main gear rotates a predetermined amount in the other direction to limit the angular distance of oscillation to said smaller second angular distance, and movable by said switch means out of position between said second and third stops so that the angular distance of oscillation is determined by the engagement of said first and second stops with said first bar to limit the angular distance of oscillation to said larger first angular distance.

3. The portable heater/fan of claim 2 and wherein said switch means comprises a three button piano type switch which is electrically connected to said oscillating motor for actuating said motor and mechanically connected to said second bar for moving said second bar into and out of said position.

4. The portable heater/fan of claim 3 and wherein the means for pivotally mounting said compartment on said neck joint include spring biased screws.

5. The portable heater/fan of claim 4 and wherein the first and second angular distances are about 90 degrees and about 45 degrees respectively.

6. The portable heater/fan of claim 5 and wherein when one of the three buttons on the switch is depressed the synchronous motor is not energized, when another button is depressed the synchronous motor is energized and the second bar is moved out of said position whereby the main gear is caused to oscillate over a 90 degree angle and the second bar is moved into said position whereby when the third button is depressed the synchronous motor is energized and the main gear is caused to oscillate over a 45 degree angle.

7. An electric fan comprising:

a. base adapted to be placed on a horizontal surface for supporting an electric fan, b. support means mounted on said base for rotation about a vertical axis, c. a synchronous motor mounted on said base and operatively connected to said support means for causing said support means to rotate about said vertical axis, d. first cooperable limit means on said base and said support means for causing said synchronous motor to oscillate said support means through a first angular distance about said vertical axis, said spaced first cooperable limit means comprising first and second fixed stops on said support means and a first bar fixedly mounted on said base, e. second cooperable limit means on said base and said support means for causing said synchronous motor to oscillate said support means through a second angular distance about said vertical axis smaller than said first angular distance, said second cooperable limit means comprising said second fixed stop and a third fixed stop on said support means spaced therefrom a distance less than the distance between said first and second stops and a second bar movably mounted on said base and selectively movable into and out of position between said second and third stops, f. switch means of selectively actuating said synchronous motor and for selectively rendering either said first limit means or said second limit means operative to select the angular distance of oscillation of said support means about said vertical axis by moving said second bar into said position to render said second limit means operative and by moving said second bar out of said position to render said first limit means operative, and g. a compartment having an electric fan assembly mounted on said support means.

* * * * *